US009068300B2

(12) United States Patent
Fielder

(10) Patent No.: US 9,068,300 B2
(45) Date of Patent: Jun. 30, 2015

(54) RIDING TROWEL WITH CVT CLUTCH MODULE

(71) Applicant: Allen Engineering Corporation, Paragould, AR (US)

(72) Inventor: Jeffrey Lynn Fielder, Bono, AR (US)

(73) Assignee: Allen Engineering Corporation, Paragould, AR (US)

( * ) Notice: Subject to any disclaimer, the term of this patent is extended or adjusted under 35 U.S.C. 154(b) by 0 days.

(21) Appl. No.: 14/497,651

(22) Filed: Sep. 26, 2014

(65) Prior Publication Data

US 2015/0093194 A1 Apr. 2, 2015

Related U.S. Application Data

(60) Provisional application No. 61/884,456, filed on Sep. 30, 2013.

(51) Int. Cl.
*E01C 19/42* (2006.01)
*E04F 21/24* (2006.01)

(52) U.S. Cl.
CPC ..... *E01C 19/42* (2013.01); *E04F 21/247* (2013.01); *E04F 21/245* (2013.01); *E04F 21/24* (2013.01)

(58) Field of Classification Search
CPC ..... E04F 21/24; E04F 231/145; E04F 21/247; E04F 21/248; E01C 19/42
USPC ..... 404/112
See application file for complete search history.

(56) References Cited

U.S. PATENT DOCUMENTS

| | | | |
|---|---|---|---|
| 2,599,330 | A | 6/1952 | Jackson |
| 2,869,442 | A | 1/1959 | Mincher |
| 2,898,826 | A | 8/1959 | Livermont |
| 2,983,203 | A | 5/1961 | Fletcher |
| 3,095,789 | A | 7/1963 | Metvis |
| 3,110,234 | A | 11/1963 | Oster |
| 3,113,494 | A | 12/1963 | Barnes |
| 3,220,322 | A | 11/1965 | Lewis |
| 3,299,785 | A | 1/1967 | Godbersen |
| 3,377,933 | A | 4/1968 | Dale |
| 3,412,657 | A | 11/1968 | Colizza |
| 3,450,011 | A | 6/1969 | Godbersen |
| 3,541,931 | A | 11/1970 | Godbersen |
| 3,572,227 | A | 3/1971 | Paulsen |
| RE28,561 | E | 9/1975 | Stephens |

(Continued)

FOREIGN PATENT DOCUMENTS

JP 2224057 4/1990

OTHER PUBLICATIONS www.polaris.com—Drive Train, Main Gearcase Internals of a CVT Clutch Module—Model R13th.

*Primary Examiner* — Raymond W Addie
(74) *Attorney, Agent, or Firm* — Stephen D. Carver

(57) ABSTRACT

A power riding trowel for finishing concrete comprising rotors turned by gearboxes driven by gearbox driveshaft's linked to the moor output by CVT gear ratio control. The motor output shaft drives a first jackshaft driven at a higher speed than the motor RPM. A CVT pulley assembly comprising first and second CVT pulleys and a CVT belt entrained between them has a first CVT pulley driven by the first jackshaft. A second jackshaft splined to the second CVT pulley drives the gearbox driveshaft at a speed lower than said second jackshaft to operate the rotor means at a proper speed and torque.

2 Claims, 12 Drawing Sheets

(56) References Cited

U.S. PATENT DOCUMENTS

| | | | |
|---|---|---|---|
| 3,936,212 | A | 2/1976 | Holz, Sr. |
| 3,973,857 | A | 8/1976 | Whiteman, Jr. |
| 4,027,991 | A | 6/1977 | Maass |
| 4,046,483 | A | 9/1977 | Sutherland |
| 4,046,484 | A | 9/1977 | Holz, Sr. |
| 4,198,178 | A | 4/1980 | Carlstrom |
| 4,232,980 | A | 11/1980 | Tertinek |
| 4,312,603 | A | 1/1982 | Whiteman, Jr. |
| 4,320,986 | A | 3/1982 | Morrison |
| 4,388,017 | A | 6/1983 | Morrison |
| 4,556,339 | A | 12/1985 | Morrison |
| 4,577,993 | A | 3/1986 | Allen |
| 4,629,359 | A | 12/1986 | Sengupta |
| 4,673,311 | A | 6/1987 | Whiteman, Jr. |
| 4,676,691 | A | 6/1987 | Morrison |
| 4,710,055 | A | 12/1987 | Maass |
| 4,752,154 | A | 6/1988 | Valentine |
| 4,775,306 | A | 10/1988 | Kikuchi |
| 4,784,519 | A | 11/1988 | Artzberger |
| 4,859,114 | A | 8/1989 | Artzberger |
| 4,977,928 | A | 12/1990 | Smith |
| D323,510 | S | 1/1992 | Allen |
| 5,108,220 | A | 4/1992 | Allen |
| 5,129,708 | A | 7/1992 | Swan |
| 5,190,401 | A | 3/1993 | Wilson |
| 5,221,156 | A | 6/1993 | Martin |
| 5,238,323 | A | 8/1993 | Allen |
| D340,340 | S | 10/1993 | Allen |
| D344,736 | S | 3/1994 | Allen |
| 5,377,774 | A | 1/1995 | Lohr |
| 5,405,216 | A | 4/1995 | Allen |
| 5,476,342 | A | 12/1995 | Allen |
| 5,480,257 | A | 1/1996 | Allen |
| 5,480,258 | A | 1/1996 | Allen |
| 5,533,830 | A | 7/1996 | Barichello |
| 5,533,831 | A | 7/1996 | Allen |
| 5,584,598 | A | 12/1996 | Watanabe |
| 5,613,801 | A | 3/1997 | Allen |
| 5,658,089 | A | 8/1997 | Allen |
| 5,685,667 | A | 11/1997 | Allen |
| 5,690,567 | A | 11/1997 | DeNijs |
| 5,803,658 | A | 9/1998 | Allen |
| 5,816,739 | A | 10/1998 | Allen |
| 5,816,740 | A | 10/1998 | Jaszkowiak |
| D400,542 | S | 11/1998 | Allen |
| D400,544 | S | 11/1998 | Allen |
| D402,998 | S | 12/1998 | Allen |
| D402,999 | S | 12/1998 | Allen |
| D403,332 | S | 12/1998 | Allen |
| D404,041 | S | 1/1999 | Allen |
| 5,890,833 | A | 4/1999 | Allen |
| D410,931 | S | 6/1999 | Allen |
| D413,127 | S | 8/1999 | Allen |
| 5,934,823 | A | 8/1999 | Allen |
| 5,967,696 | A | 10/1999 | Allen |
| D416,564 | S | 11/1999 | Allen |
| 5,988,938 | A | 11/1999 | Allen |
| 6,019,545 | A | 2/2000 | Allen |
| 6,048,130 | A | 4/2000 | Allen |
| 6,053,660 | A | 4/2000 | Allen |
| 6,089,786 | A | 7/2000 | Allen |
| 6,089,787 | A | 7/2000 | Allen |
| 6,106,193 | A | 8/2000 | Allen |
| 6,120,399 | A | 9/2000 | Okeson |
| 6,155,940 | A | 12/2000 | Templeton |
| D453,344 | S | 2/2002 | Smith |
| D465,897 | S | 11/2002 | Smith |
| D466,909 | S | 12/2002 | Allen |
| D474,203 | S | 5/2003 | Allen |
| 6,569,043 | B2 | 5/2003 | Youngren |
| 6,582,153 | B1 | 6/2003 | Allen |
| 6,857,815 | B2 | 2/2005 | Allen |
| 6,953,400 | B2 | 10/2005 | Kalies |
| 6,958,025 | B2 | 10/2005 | Huddleston |
| 6,988,851 | B2 | 1/2006 | Sina |
| 6,994,643 | B2 | 2/2006 | Kalies |
| 7,063,633 | B2 | 6/2006 | Robert |
| 7,081,057 | B2 | 7/2006 | Kalies |
| 7,090,600 | B2 | 8/2006 | Lohr |
| 7,104,725 | B1 | 9/2006 | Kipp |
| 7,114,876 | B1 | 10/2006 | Allen |
| 7,775,740 | B2 | 8/2010 | Berritta |
| 7,927,241 | B2 | 4/2011 | Labbe |
| 8,132,983 | B2 | 3/2012 | Lutz |
| 8,360,680 | B2 | 1/2013 | Allen |
| 8,511,934 | B1 | 8/2013 | Paske |
| 8,668,607 | B2 | 3/2014 | Brind'Amour |
| 8,682,549 | B2 | 3/2014 | Roberge |
| 8,684,886 | B2 | 4/2014 | Roberge |
| 2010/0113202 | A1* | 5/2010 | Treichel et al. ..... 475/5 |
| 2013/0109522 | A1* | 5/2013 | Calvert ..... 475/1 |

* cited by examiner

RIDING TROWEL WITH CVT CLUTCH MODULE

CROSS REFERENCE TO RELATED APPLICATION

This utility patent application is based upon, and claims filing date priority from, a prior U.S. Provisional Patent application entitled "Riding Trowel CVT Clutch Module," by inventor Jeffrey Lynn Fielder, Ser. No. 61/884,456, filed Sep. 30, 2013, which is hereby incorporated by reference as if fully set forth herein.

BACKGROUND OF THE INVENTION

I. Field of the Invention

The present invention relates generally to motorized riding trowels for finishing concrete. More particularly, the present invention relates to transmissions for powered riding trowels of the type classified in United States Patent Class 404, Subclass 112, and particularly to CVT transmission systems for such trowels.

II. Description of the Prior Art

It has long been recognized by those skilled in the art that freshly placed concrete must be appropriately finished. Proper and timely finishing insures that desired surface characteristics including appropriate smoothness and flatness are achieved. Motorized riding trowels are ideal for finishing very large areas of plastic concrete quickly and efficiently, and such trowels have become a standard in the industry.

A typical power riding trowel comprises two or more bladed rotors that project downwardly and frictionally contact the concrete surface for finishing. These rotors are driven by one or more motors mounted on the frame. Typically the motors drive suitable reduction gearboxes (i.e., 20:1 reduction) to power the rotors. The riding trowel operator sits on top of the frame and controls trowel movement with a steering system that tilts the axis of rotation of the rotors. The weight of the trowel and the operator is transmitted frictionally to the concrete by the revolving blades. The unbalanced frictional forces caused by rotor tilting enable the trowel to be steered.

Holz, in U.S. Pat. No. 4,046,484 shows a pioneer, twin rotor, self propelled riding trowel. U.S. Pat. No. 3,936,212, also issued to Holz, shows a three rotor riding trowel powered by a single motor. Although the designs depicted in the latter two Holz patents were pioneers in the riding trowel arts, the devices were difficult to steer and control.

Prior U.S. Pat. No. 5,108,220 owned by Allen Engineering Corporation, the same assignee as in this case, relates to an improved, fast steering system for riding trowels. Its steering system enhances riding trowel maneuverability and control. The latter fast steering riding trowel is also the subject of U.S. Pat. No. Des. 323,510 owned by Allen Engineering Corporation.

Allen Engineering Corporation U.S. Pat. No. 5,613,801 issued Mar. 25, 1997 discloses a power riding trowel equipped with twin motors. The latter design employs a separate motor to power each rotor. Steering is accomplished with structure similar to that depicted in U.S. Pat. No. 5,108,220 previously discussed.

Allen U.S. Pat. No. 5,480,257 depicts a twin engine powered riding trowel whose guard structure is equipped with an obstruction clearance system. When troweling areas characterized by projecting hazards such as pipes or ducts, or when it is necessary to trowel hard-to-reach areas adjacent walls or the like, the guard clearance structure may be retracted to apply the blades closer to the target region.

Allen U.S. Pat. No. 5,685,667 depicts a twin engine riding trowel using "contra rotation." For enhanced stability and steering, the rotors rotate in a direction opposite from that normally expected in the art.

As freshly poured concrete "sets," it soon becomes hard enough to support the weight of the specialized finishing trowel, so pan finishing can begin. By starting panning while concrete is still "green," within one to several hours after pouring depending upon the concrete mixture involved, "super-flat" and "super-smooth" floors can be achieved. The advent of more stringent concrete surface finish specifications using "F" numbers to specify flatness (ff) and levelness (fl), dictates the use of pans on a widespread basis.

The panning process comprises three different recognizable stages. In the initial "brake open" stage, the rotors are ideally driven between 40 and 65 RPM. As the concrete hardens, the pan floating stage occurs, involving rotor speeds between 70 and 95 RPM. The last phase of pan floating, the "fuzz stage," uses an increased rotor speed of between 95-125 RPM. At present these RPM requirements are achieved simply by varying motor speed.

Pan finishing is normally followed by medium speed blade finishing, after the pans are removed from the rotors. An enhancement is the use of "combo blades" during the intermediate "fuzz stage" as the concrete continues to harden. So-called "combo-blades" are a compromise between pans and normal finishing blades. They present more surface area to the concrete than normal finishing blades, and attack at a less acute angle. The rotors are preferably turned between 100 to 135 RPM at this time. Finishing blades are then used, and they are rotated between 120 to 150 RPM. Finally, the pitch of the blades is changed to a relatively high contact angle, and burnishing begins. This final trowel finishing stage uses rotor speeds of between 135 and 165 RPM.

Modern large, high power riding trowels can deliver substantial horsepower. During use, however, the drive train, the gearboxes, the rotors and the motors are subject to substantial stresses. Motor loading varies as the rotor RPM requirements change. Furthermore, ideal rotation speeds can vary depending upon the concrete, whose frictional characteristics vary between the freshly poured and stricken off stage, the subsequent green stages, and the end stages occurring after final curing and hardening. The motors function most efficiently at a given operating point in their characteristic horsepower-RPM and torque-RPM curves. Especially with diesel engines, optimum torque and horsepower requirements are achieved over a limited RPM range.

The engines on most riding trowels directly power the reduction drive gear boxes connected to the rotor shafts. The incoming shaft speed of the conventional rotor gear box is the same as the motor output RPM. The gearbox output shaft speed (i.e., rotor speed) is reduced, approximately 20:1. Engine RPM is usually the key variable related to output power. However, with engine speed increases, excessive power may be developed and the finishing mechanism may rotate too fast. For example, the initial panning stage requires relatively high power because of the viscous character of the still-wet concrete, but relatively low rotor speeds are desired. Since the rotors are driven through a fixed ratio, established by the gearbox and pulleys, optimum engine power often cannot be obtained during panning without risking excessive rotor speeds.

It has thus proven desirable to provide a CVT riding trowel wherein the engine and gear boxes can operate at ideal speeds over a wide range of finishing conditions.

U.S. Pat. No. 5,967,696 Oct. 19, 1999 issued to Allen Engineering Corporation depicts a CVT riding trowel, i.e., a trowel with a variable ratio transmission. The trowel described in the latter patent includes a CVT drive train powering a pair of rotors. The rotors are shaft-driven by reduction gear boxes. The CVT system comprises a variable ratio pulley driven by the motor. A second variable ratio pulley drives the gear box input shaft, with a drive belt entrained between the twin, variable ratio pulleys. Means are provided to change the effective diameters of a pair of belt-coupled pulleys. The varying ratio between the pulleys establishes a variable, overall drive gear ratio. However, it has been found that with the latter design, the CVT pulleys do not operate at a high-enough speed to promote efficiency.

Other continuously variable transmission devices not specific to riding trowels are seen in U.S. Pat. Nos. 8,682,549, 8,668,607, 8,686,886, 7,063,633, 6,994,643, 7,081,057, 7,090,600, 6,569,043, 6,120,399, 6,958,025, 6,953,400, 6,155,940, and 5,377,774.

It has recently been realized that improved efficiency of the overall power train results where the CVT transmission system, in a riding trowel for example, can operate at what would otherwise be classified as an excessive speed. For example, the first stage couplings or pulleys in a conventional CVT system operate at the drive motor output shaft speed or RPM. Variable gear reduction offered to the gearbox drive shaft then reduces applied RPM from that of the motor. It has been discovered that a CVT system that first increases the RPM speed from the motor, to operate the CVT pulleys at higher-than-expected speed, results in efficiency gains. Subsequent gear reduction to the gearbox drive shaft enables the motor to run at its desired speed at maximum intervals, while facilitating proper gear box speed. At the same time, over-torque of the CVT pulleys is avoided and belt breakage is avoided.

SUMMARY OF THE INVENTION

This invention provides a continuously variable ratio transmission (i.e., "CVT") module ideally for powered concrete finishing riding trowels and the like that couples between the drive motor or motors and the lower drive train. CVT modules may be employed with single engine or multiple engine riding trowels, and they are ideal for diesel applications, natural gas engines, and traditional gasoline powered motors.

The preferred riding trowel comprises one or more engines for powering downwardly projecting rotors whose blades frictionally contact the concrete surface. The rotors are driven by reduction gear boxes that are shaft activated. By tilting the rotors steering forces are developed. The CVT module is mechanically interposed between the motor output shaft and the lower gear box input shaft, being connected with conventional V-belts entrained about suitably positioned pulleys.

The CVT configuration facilitates higher power applications by reducing the torque and subsequently the belt tension in the CVT. Belt tension is directly related to the torque on the rotating pulleys. Power is the product of torque and speed. Therefore increasing the speed of the CVT pulleys will result in lower torque. The CVT module input section steps up the applied motor speed, rather than stepping it down. With the enhanced CVT first stage input speed, and resultant torque and RPM characteristics, overall efficiency is achieved. Subsequent CVT pulley sections reduce speed sufficiently to drive the gearbox shafts at a desired speed.

Thus a basic object of my invention is to increase efficiency of a powered riding trowel, or other motor-powered device, when employing a CVT transmission.

A basic object of my invention is to provide a CVT module for power finishing trowels or similar motor-powered equipment.

It is also an object to accommodate larger engines in a riding trowel of the type described. It is a feature of the invention that engines up to sixty horsepower may be employed without damaging the drive train.

A related object is to optimize trowel efficiency and CVT efficiency by allowing the CVT transmission to operate at speeds higher than the motor output shaft speed, and to gear down the output speed to match the required rotor gearbox speed.

Another related object is to properly modify the torque and rotational speed of key components in a complex CVT-equipped powered riding trowel.

Yet another object is to provide an enhanced, modular CVT system ideal for riding trowels that enables the rotors to operate at a variety of speeds while allowing the drive motor or motors to operate at optimum speeds.

Another important object is to provide a CVT system whereby motor speeds can be varied during concrete finishing operations, while rotor speeds are substantially maintained.

Conversely, an important object is to enable rotor speed to be varied substantially as desired during different finishing stages, while maintaining substantially constant motor speed and motor torque.

A basic object, that is intertwined with all of the above, is to increase the efficiency of a CVT power unit by allowing it to run at higher-than-normal speeds (i.e., 6000 RPM) while maintaining the proper motor and gearbox speeds employed by the riding trowel.

Another basic object of my invention is to provide an optimum, overall gear ratio at all times during the riding trowel finishing process.

Another important object is to lock the drive train into different gear ratios that are selected during different finishing stages to maintain the desired operating parameters.

A related object is to provide a CVT module for ridding trowels that is ideal either during panning or blading.

A still further object of our invention is to provide a CVT module for riding trowels that increases production and efficiency.

A still further object of my invention is to provide a modularized CVT system of the character described that may be quickly installed or removed from riding trowels during service and/or maintenance.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

The subject matter of this patent is related to one or more of the following U.S. Pat. Nos. D323,510 issued January 1992; U.S. Pat. No. 3,936,212 issued February 1976; U.S. Pat. No. 4,046,484 issued Sep. 6, 1977; U.S. Pat. No. 4,312,603 issued Jan. 26, 1982; U.S. Pat. No. 4,556,339 issued Dec. 3, 1985; U.S. Pat. No. 4,676,691 issued Jun. 10, 1987; U.S. Pat. No. 4,710,055 issued Dec. 1, 1987, U.S. Pat. No. 5,108,220 issued Apr. 28, 1992; U.S. Pat. No. 5,238,323 issued Aug. 24, 1993; U.S. Pat. No. 5,405,216 issued Apr. 11, 1995; U.S. Pat. No. 5,480,257 issued Jan. 2, 1996; U.S. Pat. No. 5,480,258 issued Jan. 2, 1996; U.S. Pat. No. 5,613,801 issued Mar. 25, 1997; U.S. Pat. No. 5,658,089 issued Aug. 19, 1997; U.S. Pat. No. 5,685,667 issued Nov. 11, 1997; U.S. Pat. No. 5,803,658 issued Sep. 8, 1998; U.S. Pat. No. 5,934,823 issued Aug. 10, 1999; U.S. Pat. No. 5,967,696 issued Oct. 19, 1999, U.S. Pat. No. 5,988,938 issued Nov. 23, 1999; and, U.S. Pat. No. 6,019,545 issued Feb. 1, 2000. For purposes of disclosure, and compliance with enablement and disclosure requirements of 35 USC Sec. 112 et. Seq., the foregoing patents are hereby incorporated by reference as if fully set forth herein.

Figure 1:
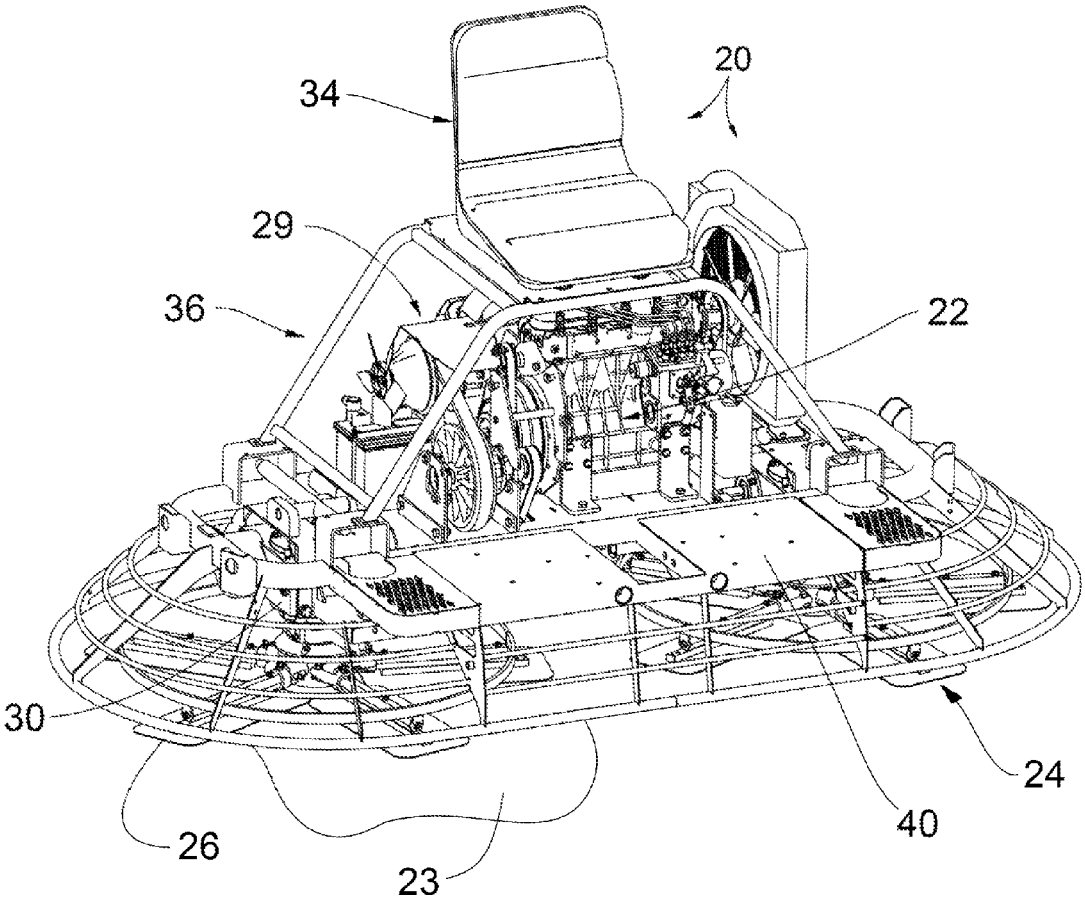
FIG. 1 is a frontal isometric view of a typical motorized, riding trowel equipped with my new CVT gearing system, with portions thereof shown in section or broken away for clarity or omitted for brevity.
Figure 2:
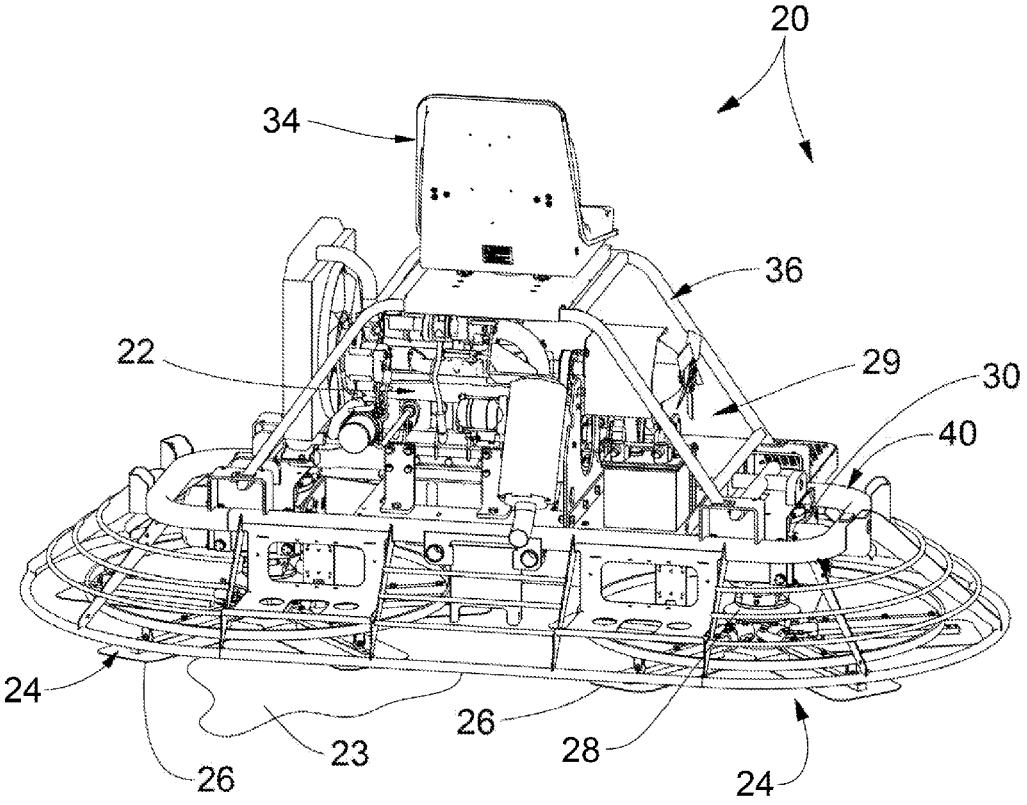
FIG. 2 is a rear isometric view of the concrete finishing trowel of FIG. 1, equipped with my new CVT gearing system, with portions thereof shown in section or broken away for clarity or omitted for brevity.
Figure 3:
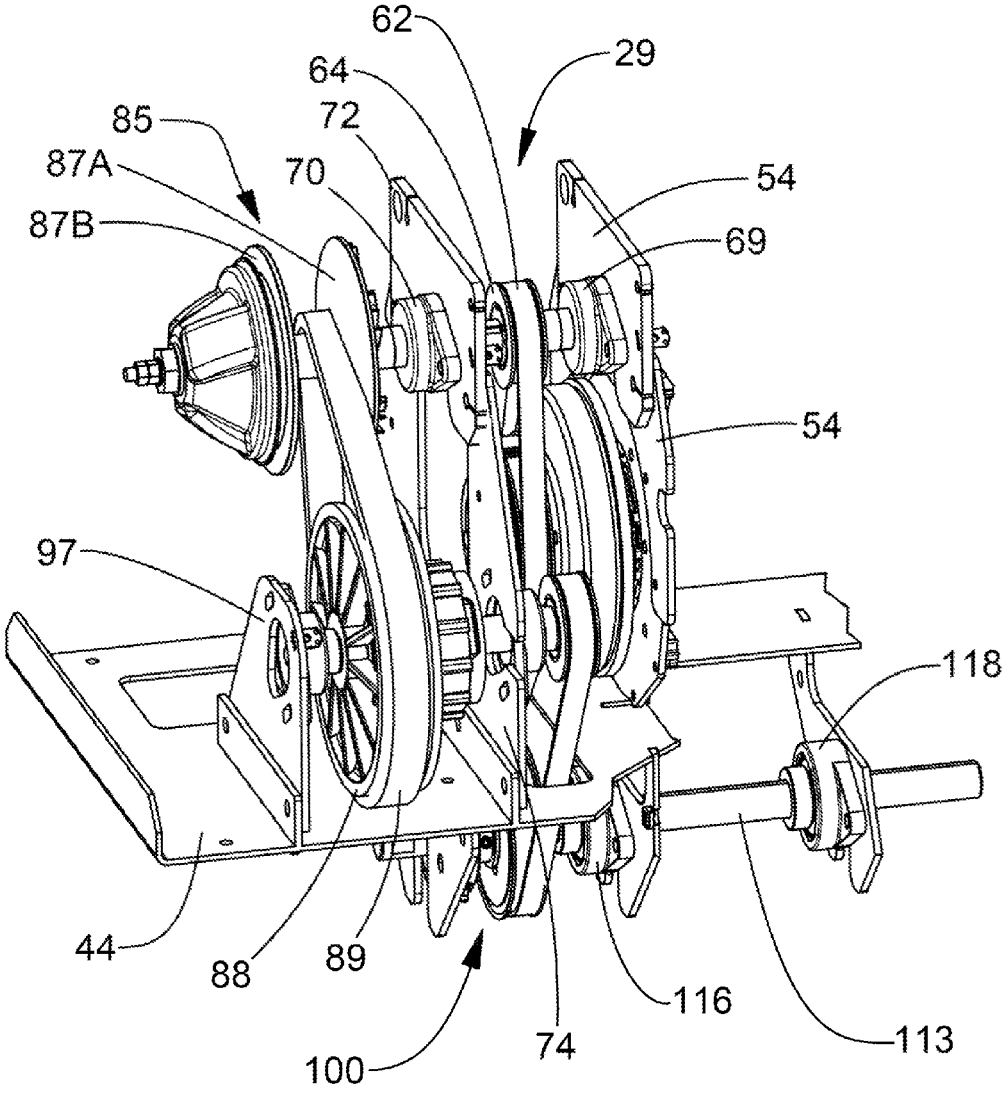
FIG. 3 is an enlarged, fragmentary, left frontal isometric view of the preferred CVT power module, with portions thereof shown in section or broken away for clarity or omitted for brevity.
Figure 4:
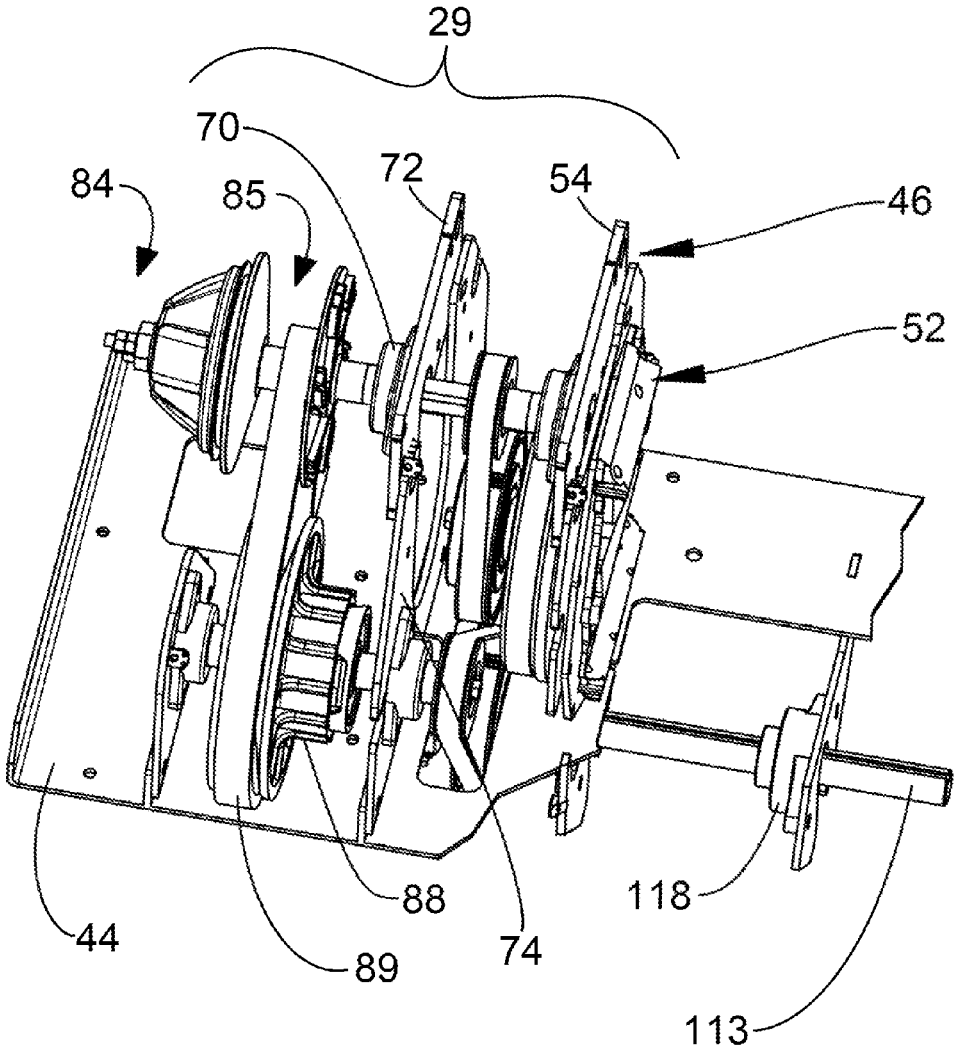
FIG. 4 is an enlarged, fragmentary, top isometric view of the preferred CVT power module, with portions thereof shown in section or broken away for clarity or omitted for brevity.

The subject matter of this patent is also related to one or more of the following other references: "Hi-Lo Variable Speed Pulley Drives" brochure by Hi-Lo Manufacturing Co. Prtd. November 1994; "TS 78 Multi-Lap Ride-On Power Trowel" Spec Sheet by Bartell Powell Products; Bartell "Power Trowels" Brochure "Speed Selector Inc.'s "Variable Speed Drives & Accessories" Brochure form 910-1-9; For purposes of disclosure, and compliance with 35 USC Sec. 112, the foregoing references are hereby incorporated by reference as if fully set forth herein FIG. 1 shows a typical dual rotor riding trowel 20 incorporating my new CVT transmission module variable gearing system. Common structural details relating to riding trowel motors, rotors, steering, rotor tilting, etc. are explained in detail in the above-cited references. It should be appreciated that trowel 20 may comprise either modern hydraulic steering, or it may employ the older manual steering arrangements such as that illustrated in U.S. Pat. No. 5,108,220. The drive engine may be diesel, gasoline, or gas powered. A variety of other differences between various riding trowels known in the art exist as well, but few of these are relevant to the employment of my CVT module.

The riding trowel 20 comprises a drive engine 22 for powering downwardly projecting, bladed rotors 24 that frictionally contact the concrete surface 23 below. The multiple, radially spaced apart blades 26 projecting from central hubs 28 are driven by gear boxes 30 to treat concrete. Engine 22 is interconnected with the gear boxes 30 via a CVT module generally designated by the reference numeral 29. The steering system may include a plurality of both manual and hydraulic linkages and actuators. By tilting the rotors appropriately, directional steering forces are developed. The operator's seat 34 may be mounted above the motor 22 proximate suitable steering handles and controls (not shown). Seat 34 rests upon a subframe 36 supported upon the trowel main frame 40.

U.S. Pat. No. 5,967,696 entitled "Riding Trowel with Variable Ratio Transmission", issued Oct. 19, 1999 discloses a riding trowel with a CVT pulley system for establishing continuously variable gear ratios. In this device the amount of power that is transferred from the engine to the gearboxes results in excessive torque. The CVT belt breaks with too much torque with larger, modern engines. To operate efficiently the CVT clutch needs to run at a faster RPM. By speeding up the CVT pulley system torque is reduced, and belt pressure or tension is reduced. This results in longer belt life. However, the gearbox shafts must run at a reduced speed. Thus the instant torque converting arrangement uses another pulley, driven by the CVT, to reduce speed and increase torque to the gearbox driveshaft. The pulley and shaft arrangement is disposed in modular form, preferably beneath the operator seat, proximate the lower gearboxes, between the twin rotors.

With joint reference now directed to FIGS. 3-8, the CVT module 29 is preferably mounted atop a rigid plate 44 that is configured to suitably attach atop the trowel main frame 40. The power input end of the CVT module has been generally designated by the reference numeral 46 in FIGS. 4, 5, and 7. The CVT module is positioned proximate the output end of the engine 22, the power output flywheel of which has been designated by the reference numeral 50 in FIG. 7. The PTO shaft 51 (i.e. FIG. 8) emanating from the flywheel 50 of the engine 22 drives the CVT module. Portions of the engine outer wall 52 are seen in FIGS. 3-8. Engine wall 52 supports a pulley idler plate 54 used by the first or input stage of the CVT module.

The power input stage of the CVT unit (i.e., the first stage) comprises a pulley 60 that is splined to PTO shaft 51. A first belt 62 entrained over pulley 60 is coupled to a reduced diameter pulley 64 that is positioned above pulley 60. Pulley 64 thus rotates faster than PTO 51. Pulley 64 is splined to a jackshaft 66 that penetrates it and terminates through a bushing 68 in a roller bearing 69 attached to plate 54 proximate the engine. Jackshaft 66 rotates at a higher speed and lower torque than the engine shaft 51.

Jackshaft 66 reaches the second stage 67 (FIG. 3) of the CVT module through a bearing 70 affixed to a support plate 72 mounted atop a vertically extending, intermediate plate 74 that is secured to horizontal plate 44. Jackshaft 66 terminates within and is splined to a variable drive CVT pulley assembly 84 in CVT module second stage 67. Pulley 84 can change its effective diameter, varying the speed and torque transmitted to lower pulley 88 by a second or CVT belt 89. CVT pulley 84 will be driven by jackshaft 66 at a higher speed than the engine shaft 51, therefore operating at a lower torque. A suitable CVT unit is available from CV Tech Company, Drummondville Quebec Canada. The CVT unit comprises a first and preferably upper pulley 85 with cooperating, conical halves 87A and 87B that are axially spaced apart a distance that establishes the belt gear ratio.

Figure 8:
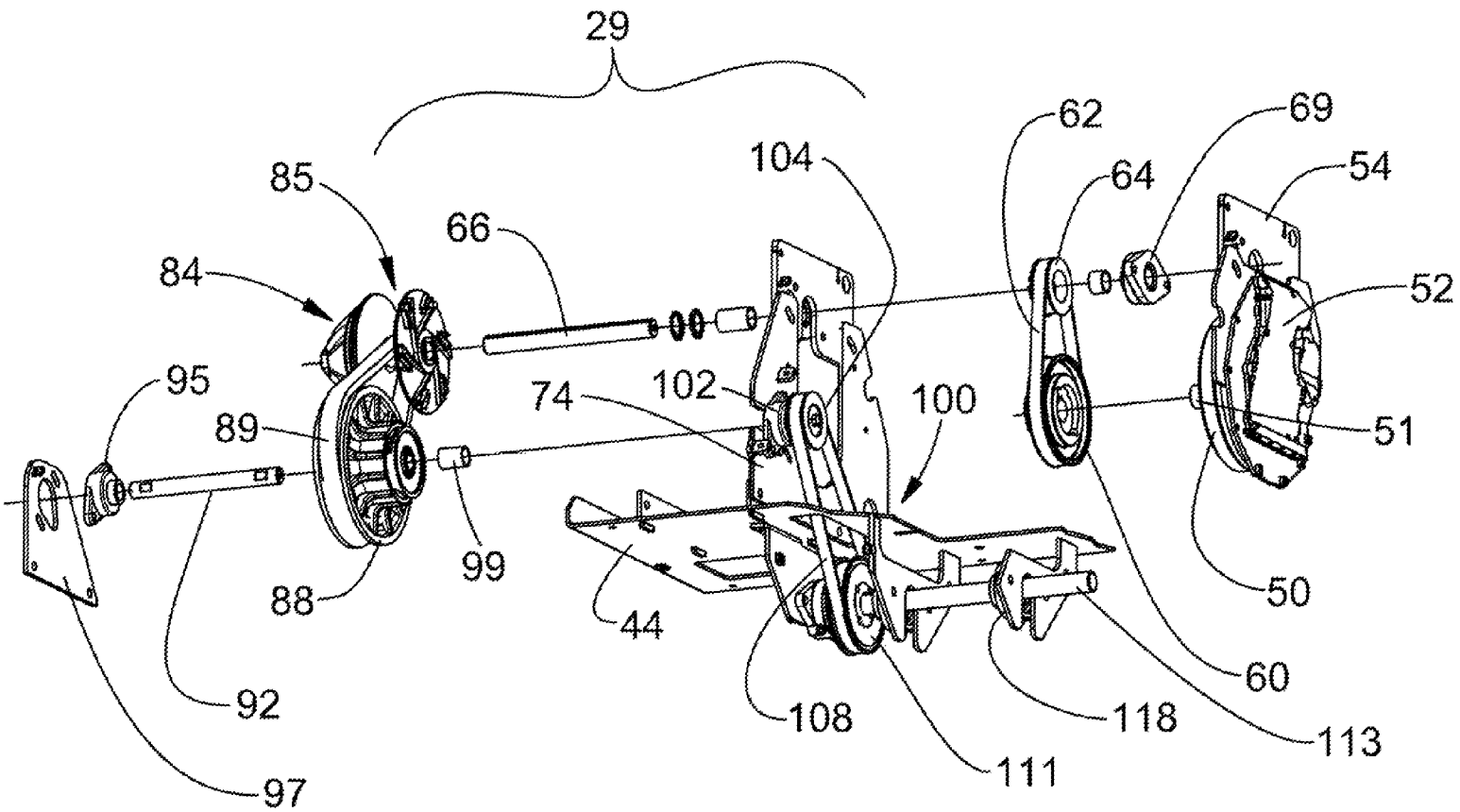
Figure 9:
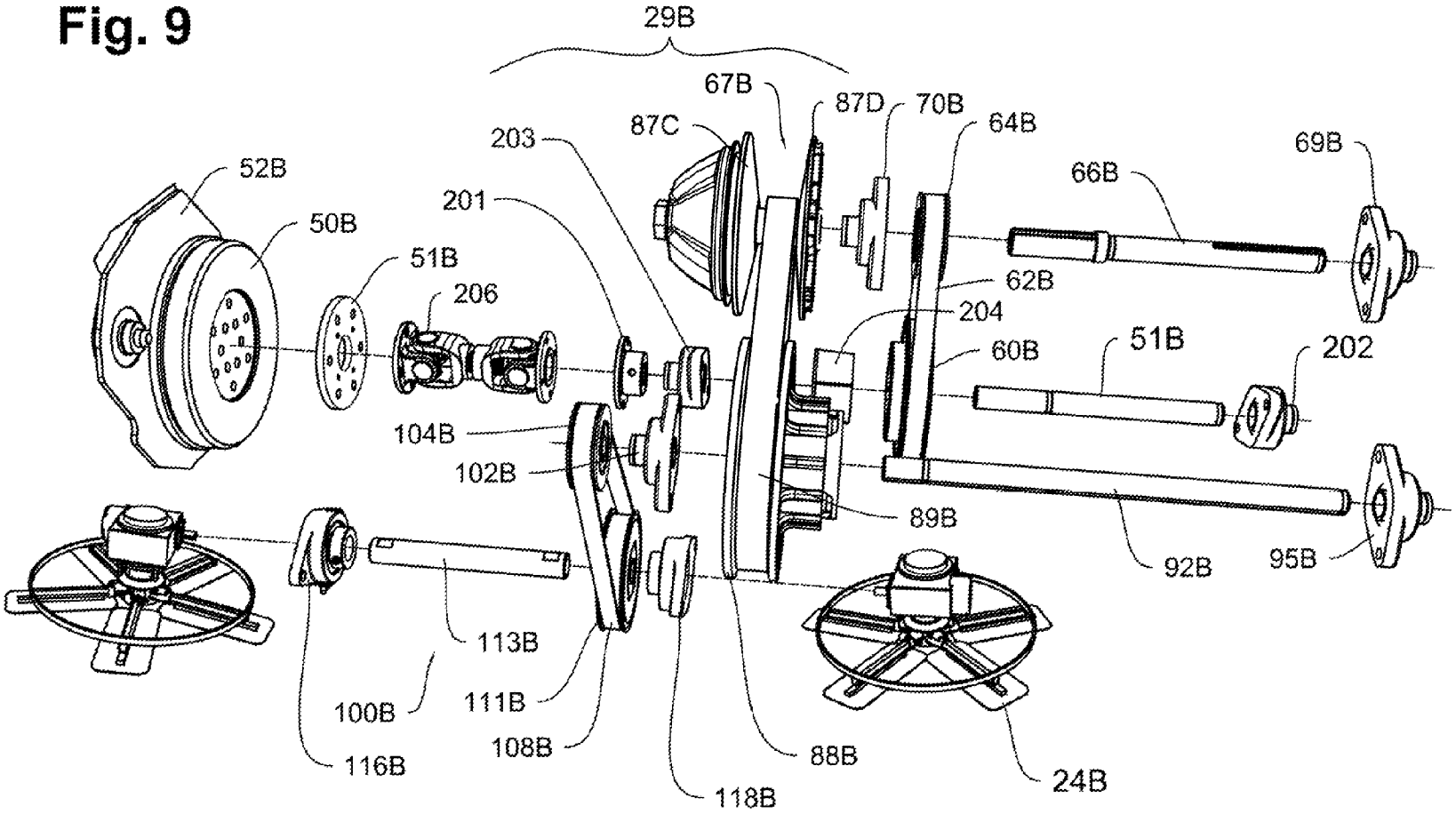
FIG. 9 is a fragmentary, frontal exploded isometric and diagrammatic view of an alternative embodiment of a CVT trowel.

A second jackshaft 92 positioned below jackshaft 66 is splined through lower CVT pulley 88. The CVT belt 89 extends to lower CVT pulley 88 from the upper CVT pulley. Jackshaft 92 extends from a roller bearing 95 that is mounted to a vertically oriented plate 97 that is secured to plate 44 near its leftward extreme. Jackshaft 92 extends through a bushing 99 and through intermediate plate 74 to the third stage of the CVT module that has generally been designated by the reference numeral 100 (FIG. 8).

Figure 5:
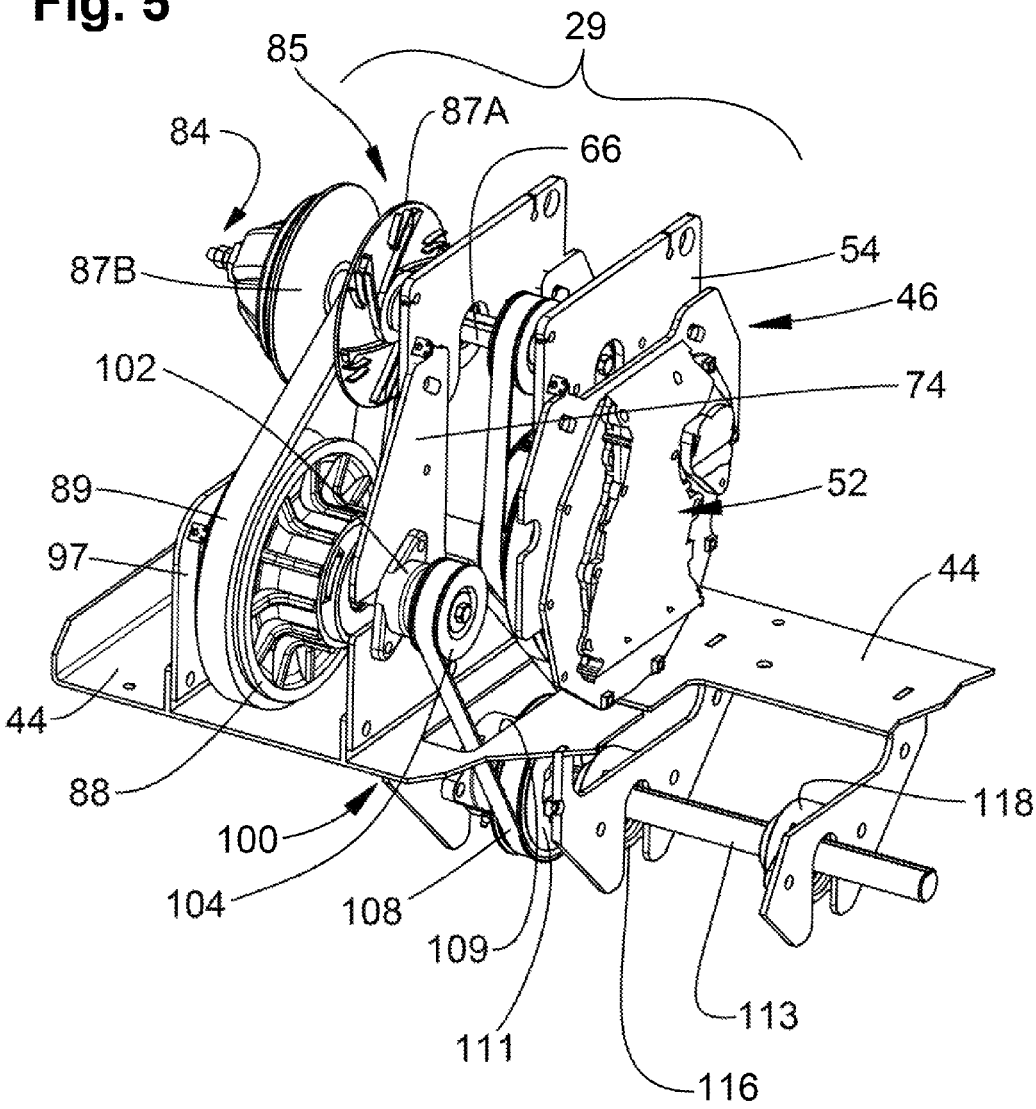
FIG. 5 is an enlarged, fragmentary, right frontal isometric view of the preferred CVT power module, with portions thereof shown in section or broken away for clarity or omitted for brevity.
Figure 6:
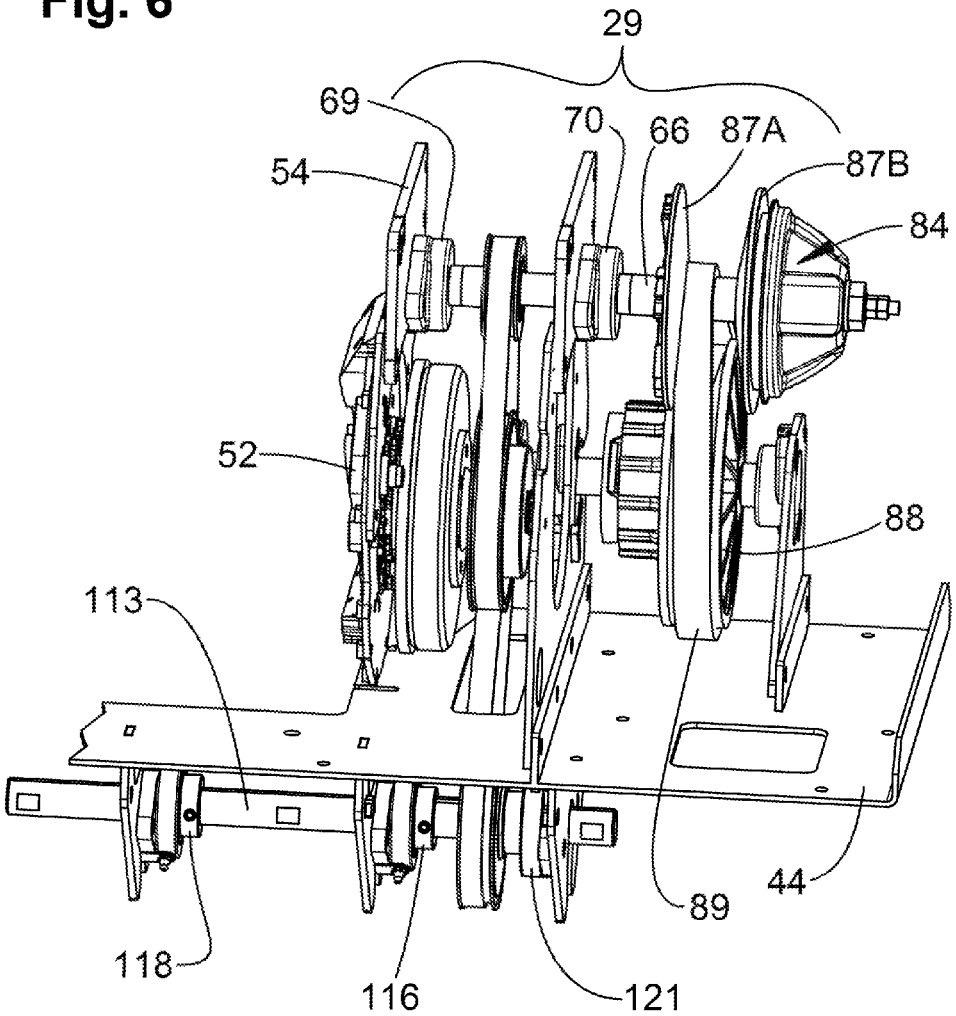
FIG. 6 is an enlarged, fragmentary, rear isometric view of the preferred CVT power module, with portions thereof shown in section or broken away for clarity or omitted for brevity.
Figure 7:
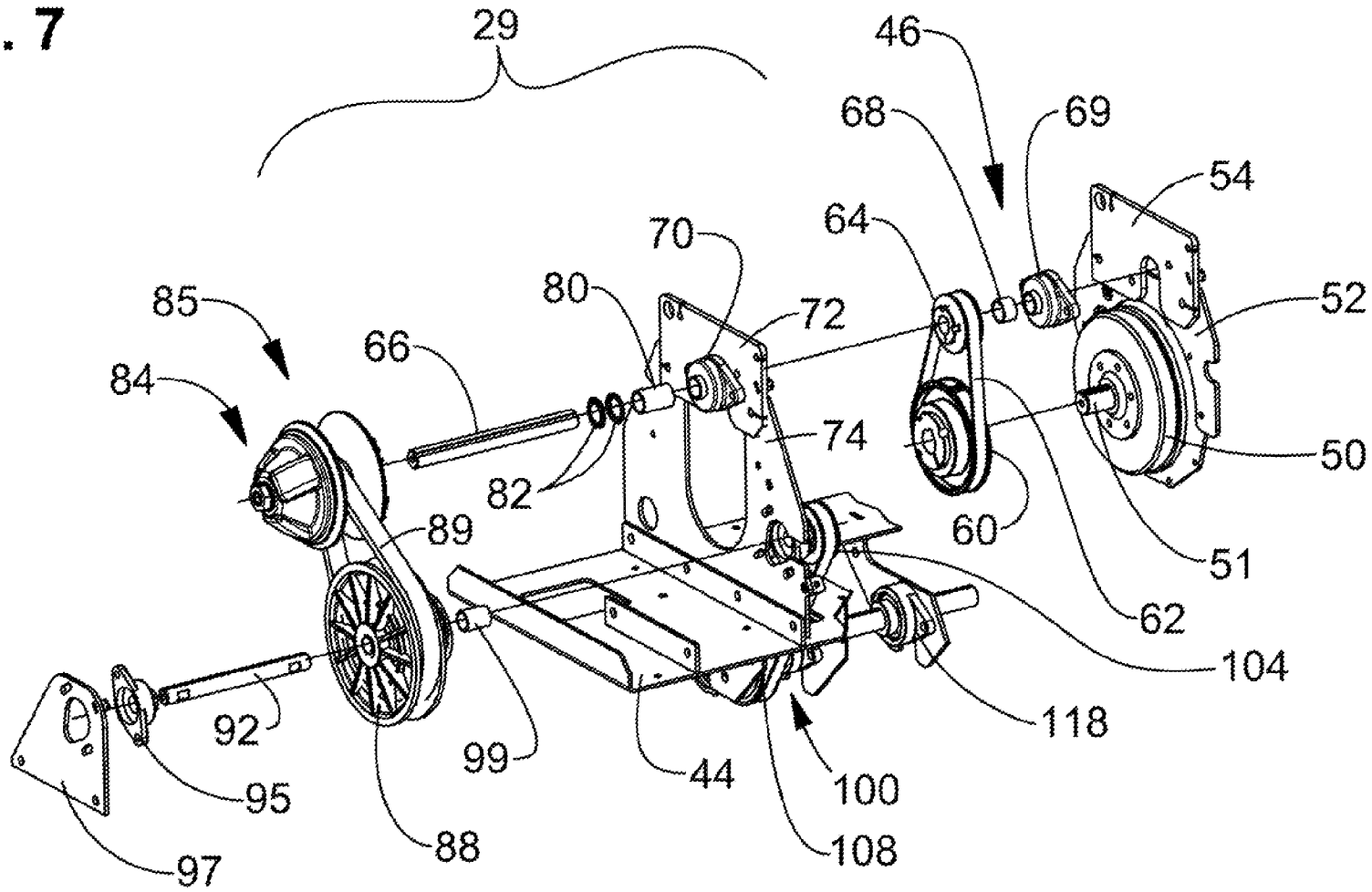
FIGS. 7 and 8 are exploded isometric assembly views, with portions thereof shown in section or broken away for clarity or omitted for brevity.

Referring now to FIGS. 5-8, jackshaft 92 terminates within stage 100 through bearing 102 in a third pulley 104 that is supported by bearing 102 and intermediate plate 74. A third belt 108 entrained over pulley 104 extends through and beneath plate 44 through an orifice 109 (FIG. 5). Belt 108 reaches a larger diameter, fourth pulley comprising lower gearbox drive pulley 111 that is coupled to the gearbox drive shaft 113. Gearbox drive shaft 113 is supported by a pair of spaced-apart bearings 116 (FIGS. 6), 118 and 121.

In short, the Allen power transmission system takes the power of the engine, which is supplied at a particular rotating speed and torque, converts it to a higher speed and lower torque which is more suitable for the CVT, then converts back to a lower speed and higher torque which is necessary for the proper speed of the gearboxes and rotors, and maximal efficiency of the trowel.

Turning to FIGS. 9-12, and alternative embodiment of a module suitable for trowel 20 (FIG. 1) has been designated by the reference numeral 29B. This embodiment is advantageous when servicing the trowel. CVT power is delivered into the module 29B from the side opposite that employed with module 29.

The alternative CVT module 29B is mounted similarly to embodiment 29 discussed above. The power input end of the CVT module 29B has been generally designated by the reference numeral 46B. The power output flywheel 50B (FIG. 10) drives PTO shaft 51B that is coaxial with flywheel 50B. Portions of the engine outer wall 52B are fragmented as in FIG. 10. Engine-driven shaft 51B penetrates a bearing 201 and U-joint assembly 206 and is anchored in thrust bearing 202 and passes through pillow block 203. Shaft 51B penetrates taper lock bushing 204 that is coaxially centered within a first pulley 60B that drives a lower diameter second pulley 64B via entrained belt 62B. Pulley 60B is thus driven by PTO shaft 51B. Pulley 64B thus rotates faster than PTO shaft 51B. Pulley 64B is splined to a first jackshaft 66B that penetrates it and terminates through a bushing 69B 54 proximate the engine. Jackshaft 66B rotates at a higher speed and lower torque than the engine shaft 51B.

Jackshaft 66 reaches the second stage 67B (FIG. 10) of the CVT module through a bearing 70B and terminates within and is splined to a variable drive CVT pulley assembly 84B in second stage 67B. Pulley assembly 84B can change its effective diameter, varying the speed and torque transmitted to lower CVT pulley 88B by a second or CVT belt 89B. CVT pulley 84B will be driven by jackshaft 66B at a higher speed than the engine shaft 51B, therefore operating at a lower torque. The CVT unit 84B comprises a first and preferably upper CVT pulley 85B with cooperating, conical halves 87C and 87D that are axially spaced apart a distance that establishes the belt gear ratio.

Preferably a second jackshaft 92B is positioned below jackshaft 66B and is splined through lower CVT pulley 88B. The CVT belt 89B extends to lower CVT pulley 88 from the upper CVT pulley. Jackshaft 92B extends from a roller bearing 95B and extends through a bushing 99B to the third stage of the CVT module that has generally been designated by the reference numeral 100B (FIG. 11).

Figure 10:
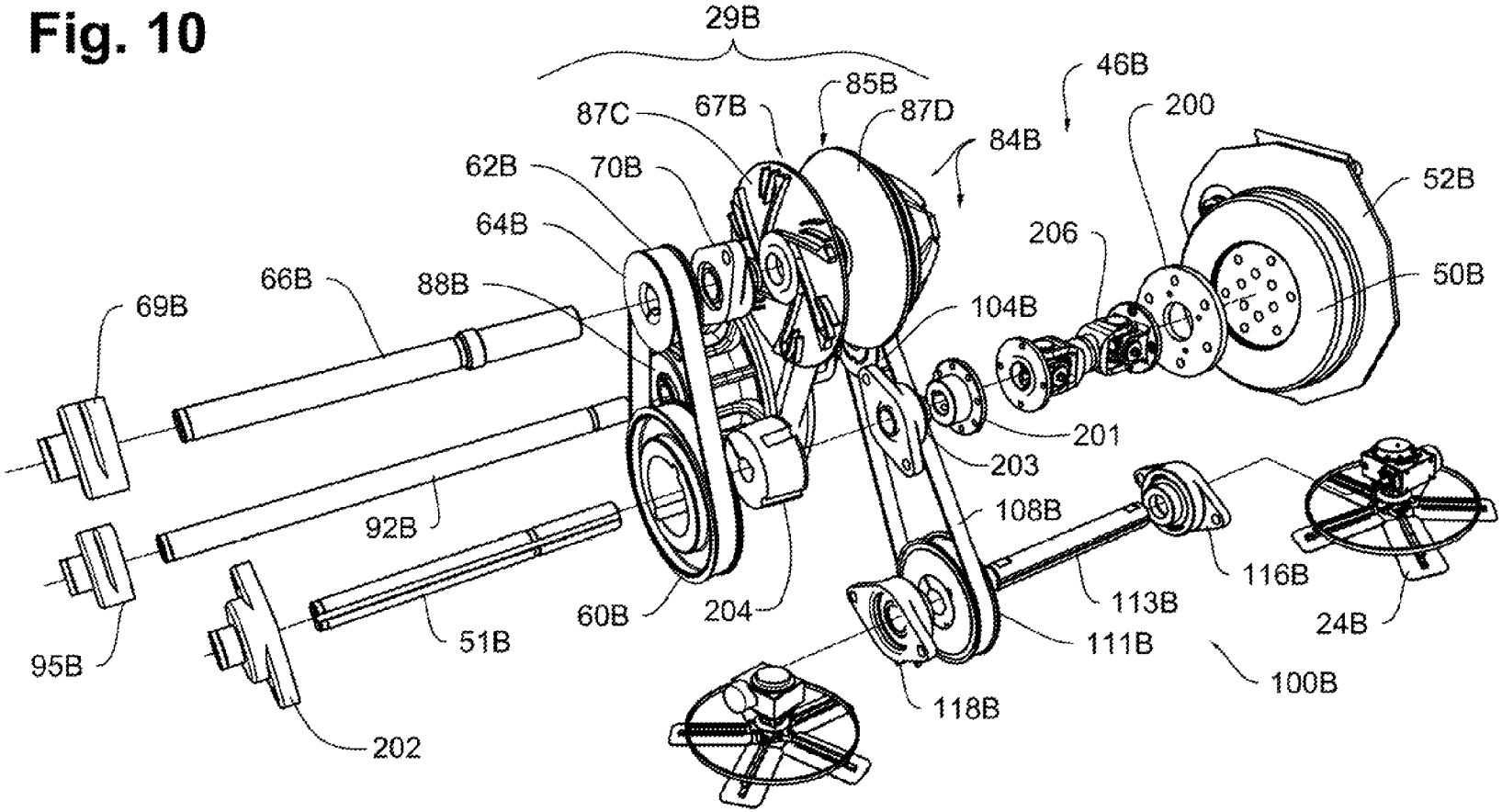
FIG. 10 is a fragmentary, rear exploded isometric and diagrammatic view of an alternative embodiment of a CVT trowel.
Figure 11:
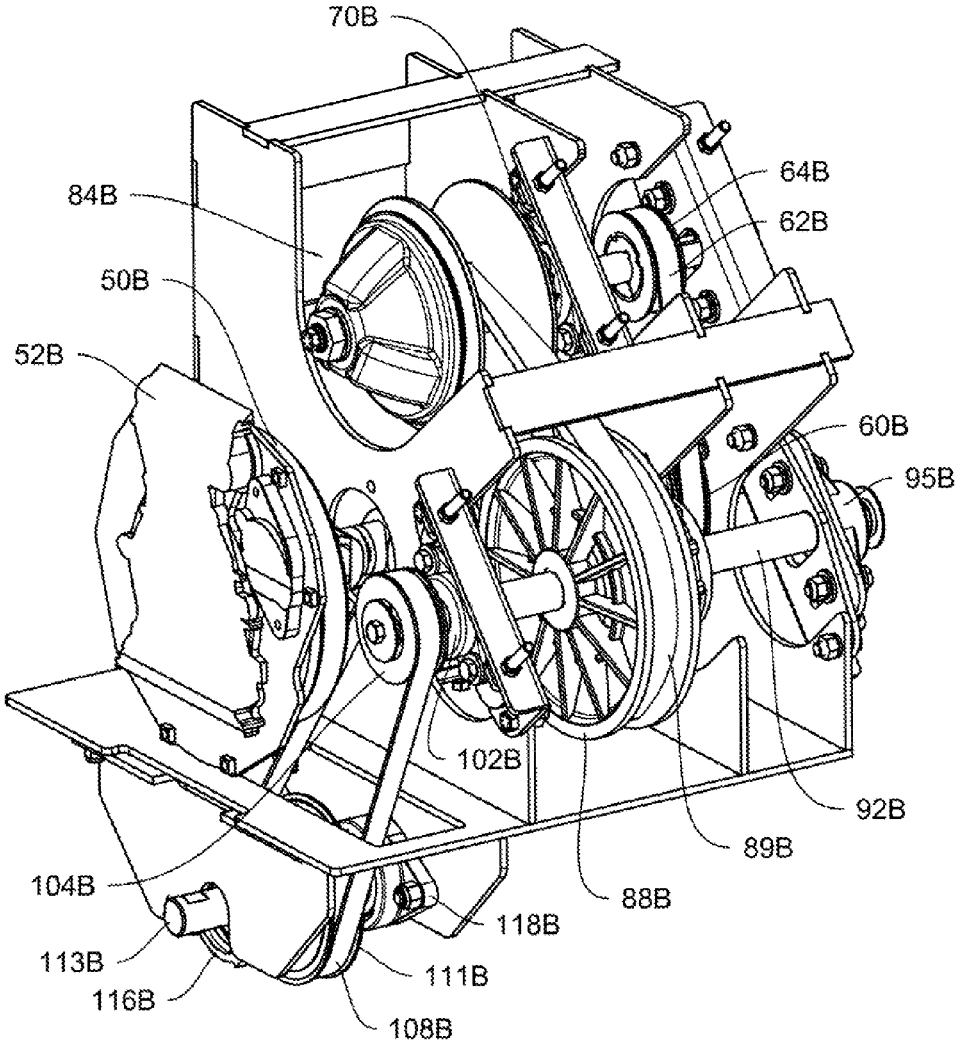
FIG. 11 is a fragmentary rear left isometric view of the trowel of FIGS. 8 and 9; and, FIG. 12 is a fragmentary front right isometric view of the trowel of FIGS. 8-10.
Figure 12:
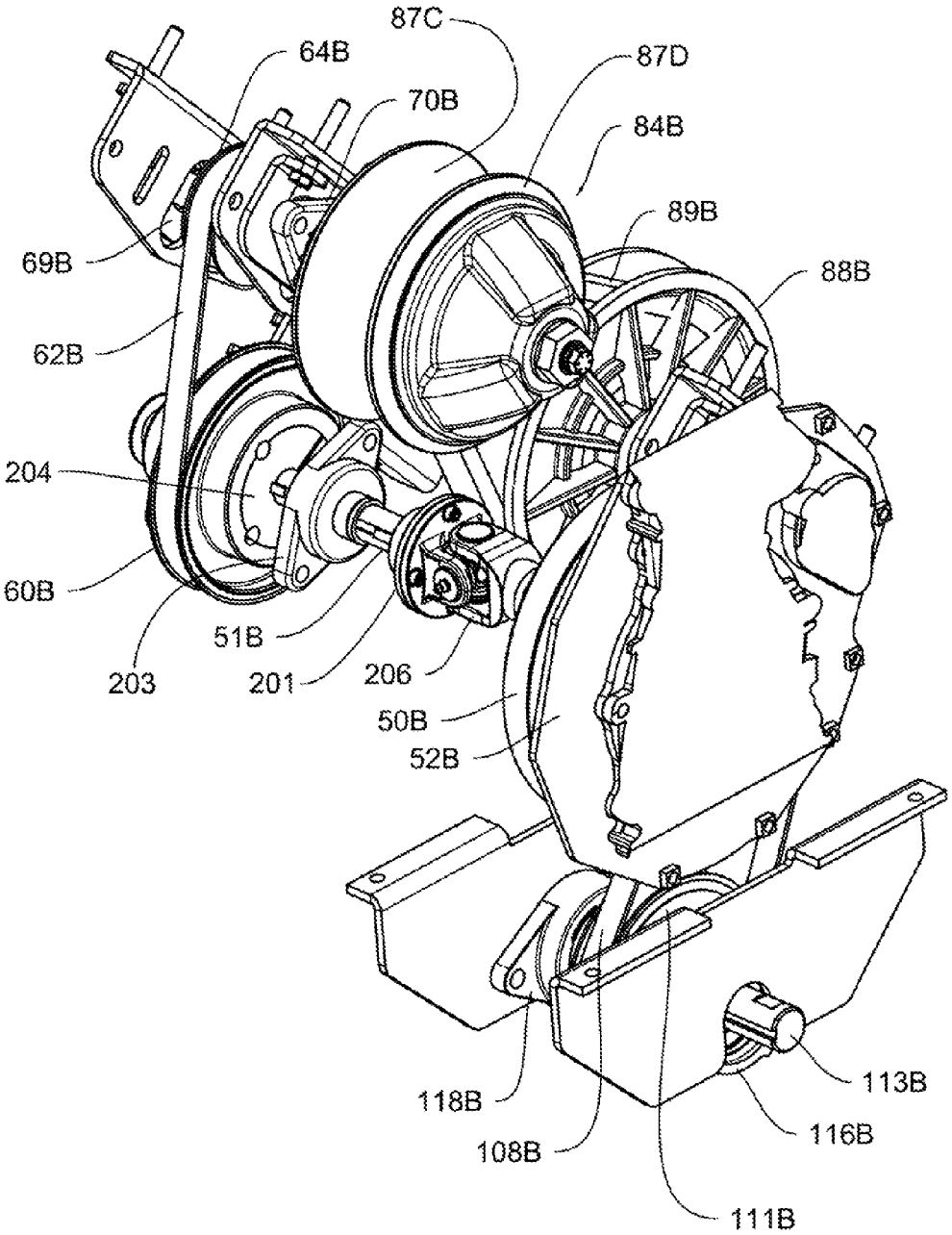

Referring now to FIGS. 10-12, jackshaft 92B terminates within stage 100B through bearing 102B and runs to a third pulley 104B. A third belt 108B entrained over pulley 104B drives a larger diameter, fourth pulley comprising lower gearbox drive pulley 111B that is coupled to the gearbox drive shaft 113B. Gearbox drive shaft 113B is supported by a pair of spaced-apart bearings 116B (FIGS. 10, 11), and 118B. The rotors 24B are gearbox driven by the gearbox shafts 113B.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A power trowel for finishing concrete, said trowel comprising:

motor means for powering said trowel, said motor means delivering power to a motor output shaft;

rotor means for treating a concrete surface;

gearbox means for driving said rotor means;

gear box driveshaft means for turning said gear box means;

a first jackshaft driven by said motor output shaft at a higher speed than the motor output shaft;

a CVT assembly comprising first and second CVT pulleys and a CVT belt entrained between them, said first CVT pulley driven by said first jackshaft;

a second jackshaft splined to said second CVT pulley and driven thereby; and, said second jackshaft driving said gearbox driveshaft means at a speed lower than said second jackshaft to operate the rotor means at a proper speed and torque.

2. A power trowel for finishing concrete, said trowel comprising:

a frame;

a seat disposed on the frame for an operator;

means accessible to a seated operator for controlling the trowel;

motor means mounted on said frame for powering said trowel, said motor means delivering power to a motor output shaft;

rotor means comprising a plurality of blades for treating a concrete surface, the rotor means projecting downwardly from said frame;

gear box means for driving said rotor means;

gear box driveshaft means for turning said gear box means;

a first pulley splined to said motor output shaft;

a first jackshaft parallel with and spaced apart from said motor output shaft;

a second pulley splined to said jackshaft, said second pulley having a smaller diameter than said first pulley and driven by a belt entrained over said first and second pulleys whereby said first jackshaft rotates at a higher speed than said motor output shaft;

a CVT pulley assembly comprising first and second CVT pulleys and a CVT belt entrained between them, said first CVT pulley splined to said first jackshaft;

a second jackshaft splined to said second CVT pulley and driven thereby;

a third pulley driven by said second jackshaft;

a fourth pulley splined to said gearbox driveshaft means, the fourth pulley having a larger diameter than the third pulley; and, a third belt entrained between said third and fourth pulleys for driving said gearbox driveshaft means.

* * * * *